US008572822B2

(12) United States Patent
Hasegawa

(10) Patent No.: US 8,572,822 B2
(45) Date of Patent: Nov. 5, 2013

(54) MALE SNAP PART

(71) Applicant: YKK Corporation, Tokyo (JP)

(72) Inventor: Kenji Hasegawa, Tokyo (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 13/741,640

(22) Filed: Jan. 15, 2013

(65) Prior Publication Data

US 2013/0152347 A1 Jun. 20, 2013

Related U.S. Application Data

(62) Division of application No. 12/919,748, filed as application No. PCT/JP2009/053691 on Feb. 27, 2009.

(30) Foreign Application Priority Data

Feb. 29, 2008 (JP) ..... 2008-050579

(51) Int. Cl.
*A44B 17/00* (2006.01)

(52) U.S. Cl.
USPC ..... 24/662; 24/614; 24/676; 24/681; 24/108

(58) Field of Classification Search
USPC ..... 24/662, 664, 676, 108, 114.4, 488, 107, 24/104, 114.05, 614, 683
See application file for complete search history.

(56) References Cited

U.S. PATENT DOCUMENTS

| | | | |
|---|---|---|---|
| 1,732,837 | A | 10/1929 | Fenton |
| 1,859,271 | A | 5/1932 | Reiter |
| 1,896,044 | A | 1/1933 | Carr |
| 1,917,852 | A | 7/1933 | Prez |
| 2,305,277 | A | 12/1942 | Sloane et al. |
| 2,342,910 | A | 2/1944 | Tinnerman |
| 2,683,908 | A | 7/1954 | Carpinella |
| 3,196,512 | A | 7/1965 | Koehl |

(Continued)

FOREIGN PATENT DOCUMENTS

| | | |
|---|---|---|
| CN | 2515999 | 10/2002 |
| DE | 2919023 | 11/1980 |

(Continued)

OTHER PUBLICATIONS

PCT International Search Report and Written Opinion, PCT Application No. PCT/JP09/053691, mailed Jun. 2, 2009.

*Primary Examiner* — Robert J Sandy
*Assistant Examiner* — Rowland D Do
(74) *Attorney, Agent, or Firm* — Kilpatrick Townsend & Stockton LLP

(57) ABSTRACT

A metallic male snap part capable of coupling with a female snap part where the projection of the male snap part can be coupled to a depression of the female snap part. The projection includes multiple relatively highly deformable portions and multiple relatively low deformable portions, the highly and low deformable portions being arranged alternately in the circumference direction of the projection. The highly deformable portions are more deformable elastically in the radial direction of the projection than the low deformable portions. Each of the highly deformable portions has a relatively large, outer bulge which bulges more outward in the radial direction than a relatively small, outer bulge of each of the low deformable portions. The projection further includes longitudinal slits and lateral slits to partition the projection into the highly deformable portions and the low deformable portions.

2 Claims, 9 Drawing Sheets

(56) References Cited

U.S. PATENT DOCUMENTS

| | | | | |
|---|---|---|---|---|
| 3,243,858 | A | 4/1966 | Melanson | |
| 3,538,557 | A | 11/1970 | Hirose | |
| 3,614,815 | A | 10/1971 | Nysten | |
| 4,728,236 | A | 3/1988 | Kraus | |
| 4,805,272 | A | 2/1989 | Yamaguchi | |
| 4,847,959 | A | 7/1989 | Shimada | |
| 4,982,480 | A | 1/1991 | Kasai | |
| 5,195,860 | A | 3/1993 | Steyn | |
| 5,207,535 | A | 5/1993 | Saab | |
| 6,227,785 | B1 * | 5/2001 | Kilgore | 411/526 |
| 6,314,621 | B1 | 11/2001 | Kawahara | |
| 6,446,320 | B2 | 9/2002 | Kilgore | |
| 6,915,900 | B2 * | 7/2005 | Chen | 206/350 |
| 8,220,116 | B2 * | 7/2012 | Schwab | 24/572.1 |
| 2004/0025306 | A1 | 2/2004 | Coffey | |
| 2005/0076484 | A1 | 4/2005 | Sussenbach et al. | |

FOREIGN PATENT DOCUMENTS

| | | |
|---|---|---|
| JP | 52-132201 | 10/1977 |
| JP | 57-187914 | 11/1982 |
| JP | 62155805 A | 7/1987 |
| JP | 62-188207 | 11/1987 |
| JP | 63234906 A | 9/1988 |
| JP | 63-185612 | 11/1988 |
| JP | 2-21929 | 6/1990 |
| JP | 3-54566 | 12/1991 |
| JP | 2001-149117 | 6/2001 |

* cited by examiner

MALE SNAP PART

This application is a divisional of U.S. patent application Ser. No. 12/919,748, filed on Dec. 2, 2010 which is a national stage application of PCT/JP2009/053691 filed on Feb. 27, 2009, which claims the benefit of Japanese Patent Application No. 2008-050579, filed on Feb. 29, 2008, all of which are incorporated herein by reference.

BACKGROUND OF THE INVENTION

The present invention relates to a male snap part and a female snap part constituting a snap fastener or a pair of snap buttons.

A snap fastener has been widely used for clothes, bags and the like, in which a cylindrical projection of the male snap part (male snap) is engaged with and disengaged from a projection receiving, cylindrical depression of the female snap part (female snap). Generally, the male snap's projection includes, at its distal end, an annular, outer bulge (male bulge) which bulges outward in the radial direction, while a cylindrical portion defining the female snap's depression includes, at its open end, an annular, inner bulge (female bulge) which bulges inward in the radial direction. In an initial state (a non-deformed state) of the male and female snaps, the outer diameter of the male bulge is slightly larger than the inner diameter of the female bulge. The projection of the male snap and/or the depression of the female snap have the capability to elastically deform (or flexibility) in the radial direction. When the male snap is attached to and detached from the female snap, the male and female bulges are engaged with each other, which deforms the former radially-inwardly and/or the latter radially-outwardly, making the outer diameter of the male bulge temporarily equal to the inner diameter of the female bulge. Once the male bulge has passed over the female bulge, they return to their respective initial states (the male and/or female bulges do not always completely return to the initial states when both snaps are coupled to each other).

Metallic male and female snaps are less deformable elastically than resinou snaps. To compensate for a shortfall of the elasticity, an additional element such as a C-shaped spring and a M-shaped spring has been added into a metal female snap, as disclosed in Japanese Examined Utility Model Application Publication Nos. H02-21929 and H03-54566, etc. However, with such an additional element, manufacturing steps and costs increase.

In metallic snaps, it has been known to provide a plurality of slits, in the circumference direction, into the projection of the male snap and/or the depression-defining portion of the female snap in order to make them more deformable elastically, as shown in U.S. Pat. Nos. 1,732,837 and 1,896,044, etc.

With the above-mentioned slits, however, it is difficult to obtain an appropriate elasticity. For example, if slits are formed in the male snap's projection relatively deeply from its top to the bottom, then the projection's elasticity will increase while its coupling strength (or detaching resistance) with respect to the female snap's depression decreases, causing the snaps to be detached too easily. On the other hand, if slits are short or shallow in the projection from its top, its elasticity may be insufficient, and therefore the force required in attaching and/or detaching the snaps rises too much.

[Patent Document 1] Japanese Examined Utility Model Application No. 02-21929

[Patent Document 2] Japanese Examined Utility Model Application No. 03-54566

[Patent Document 3] U.S. Pat. No. 1,732,837

[Patent Document 4] U.S. Pat. No. 1,896,044

SUMMARY OF THE INVENTION

An object of the present invention is to provide a metallic male snap part having an appropriate and sufficient, elastic deformability in its projection, and being able to enhance coupling strength without an additional element.

Another object of the present invention is to provide a metallic female snap part having appropriate and sufficient, elastic deformability in its cylindrical portion defining the depression, and being able to enhance coupling strength without an additional element.

In order to solve the above-mentioned problems, according to the present invention, there is provided a male snap part (male snap) made of metal having a cylindrical projection to detachably engage with a projection receiving, cylindrical depression of a female snap part (female snap), wherein the projection includes a plurality of relatively highly deformable portions at predetermined angle intervals in the circumference direction of the projection, and a plurality of remaining portions, each remaining portion being arranged between adjacent two of the highly deformable portions in the circumference direction, the highly deformable portions being more deformable elastically in the radial direction of the projection than the remaining portions, and wherein each of the highly deformable portions has a relatively large, outer bulge bulging more outward in the radial direction at the upper part of each highly deformable portion than the upper part of each of the remaining portions.

In the present invention, the projection of the metallic male includes the highly deformable portions and the remaining portions, the highly deformable portions and the remaining portions being alternately arranged in the circumference direction. Here, supposing that the elasticity of the whole projection of the male snap were the same as that of a projection with only the highly deformable portions and with no remaining portions, it would be too easy to engage the projection with the depression of the female snap, and the coupling strength between the projection and the depression would considerably decrease. On the other hand, supposing that the elasticity of the whole projection were the same as that of a projection with only the remaining portions and with no highly deformable portions, it would be too hard to engage the projection with the depression, and the coupling strength therebetween would considerably increase. For the present invention, since there are alternately arranged the highly deformable portions and the remaining portions in the projection, it is possible to raise the coupling strength rather than that with the projection having only highly deformable portions while making the engaging action between the projection and the depression easier than with the projection having only remaining portions.

Further, in the present invention, since each highly deformable portion has the large outer bulge at its upper part, which bulges more outward in the radial direction than the upper part of each remaining portion, when the coupled projection and depression are separated, the coupling strength or detaching resistance therebetween increases by the large outer bulges being considerably caught by the female bulge.

In the present invention, the number of the large outer bulges provided in the circumference direction of the projection of the male snap can be preferably three to eight or more.

In the present invention, as a metal material for making the male snap, copper alloy such as brass, aluminum alloy such as aluminum, and the like can be used.

In one embodiment of the present invention, each of the remaining portions (low deformable portions) has a relatively small, outer bulge bulging less outward in the radial direction at the upper part of each remaining portion than the large outer bulge of each highly deformable portion.

In one embodiment of the present invention, the projection includes longitudinal slits which are formed from the top of the projection to partition the projection into the highly deformable portions and the remaining portions (low deformable portions).

In one embodiment of the present invention, the projection is composed of an outer cylindrical portion, an inner cylindrical portion and a top portion which connects the upper ends of the outer and inner cylindrical portions; the longitudinal slits are formed from the top portion to the outer and inner cylindrical portions; and the projection further includes lateral slits formed in through the outer cylindrical portion, each of the lateral slits connecting the lower ends, in the outer cylindrical portion, of two longitudinal slits which define each highly deformable portion therebetween.

According to another present invention, there is provided a female snap part (female snap) made of metal having a projection receiving, cylindrical depression to detachably engage with a cylindrical projection of a male snap part (male snap), and a cylindrical portion (depression-defining portion) which defines the depression therein, wherein the cylindrical portion includes a plurality of relatively highly deformable portions at predetermined angle intervals in the circumference direction of the cylindrical portion, and a plurality of remaining portions, each remaining portion being arranged between adjacent two of the highly deformable portions in the circumference direction, the highly deformable portions being more deformable elastically in the radial direction of the cylindrical portion than the remaining portions, and wherein each of the highly deformable portions has a relatively large, inner bulge bulging more inward in the radial direction at the upper part of each highly deformable portion than the upper part of each of the remaining portions.

In the present invention, the cylindrical portion defining the depression of the metallic female includes the highly deformable portions and the remaining portions, the highly deformable portions and the remaining portions being alternately arranged in the circumference direction. Here, supposing that the elasticity of the whole depression-defining portion of the female snap were the same as that of a depression-defining portion with only the highly deformable portions and with no remaining portions, it would be too easy to engage the depression of the female snap with the projection of the male snap, and the coupling strength between the depression and the projection would considerably decrease. On the other hand, supposing that the elasticity of the whole depression-defining portion were the same as that of a depression-defining portion with only the remaining portions and with no highly deformable portions, it would be too hard to engage the depression with the projection, and the coupling strength therebetween would considerably increase. For the present invention, since there are alternately arranged the highly deformable portions and the remaining portions in the depression-defining portion, it is possible to raise the coupling strength rather than that with the depression-defining portion having only highly deformable portions while making the engaging action between the depression and the projection easier than with the depression-defining portion having only remaining portions.

Further, in the present invention, since each highly deformable portion has the large inner bulge at its upper part, which bulges more inward in the radial direction than the upper part of each remaining portion, when the coupled depression and projection are separated, the coupling strength or detaching resistance therebetween increases by the large inner bulges being considerably caught by the male bulge.

In the present invention, the number of the large inner bulges provided in the circumference direction of the cylindrical portion of the female snap can be preferably three to eight or more.

In the present invention, as a metal material for making the female snap, copper alloy such as brass, aluminum alloy such as aluminum, and the like can be used.

In one embodiment of the present invention, each of the remaining portions (non-deformable portions) has a relatively small, inner bulge bulging less inward in the radial direction at the upper part of each remaining portion than the large inner bulge of each highly deformable portion.

In one embodiment of the present invention, the cylindrical portion includes longitudinal slits to partition the cylindrical portion into the highly deformable portions and the remaining portions.

In one embodiment of the present invention, the female snap part further has an outer circumference portion extending from the upper end of the cylindrical portion outward in the radial direction, wherein the longitudinal slits extend to the outer circumference portion, wherein the outer circumference portion includes lateral slits, each of the lateral slits connecting the ends of two longitudinal slits which define each highly deformable portion therebetween.

The metallic male snap part according to the present invention is capable of enhancing coupling strength with a female snap part by giving appropriate and sufficient elastic deformability to its projection without an additional element such as a spring. Especially, the male snap can exercise high detaching resistance because the large outer bulges of the highly deformable portion are caught by a female bulge when the male and female snaps are pulled to be separated from each other horizontally in the opposite directions.

The metallic female snap part according to the present invention is capable of enhancing coupling strength with a female snap part by giving appropriate and sufficient elastic deformability to its depression-defining portion without an additional element such as a spring. Especially, the female snap can exercise high detaching resistance because the large inner bulges of the highly deformable portion are caught by a male bulge when the female and male snaps are pulled to be separated from each other horizontally in the opposite directions.

BRIEF DESCRIPTIONS OF THE DRAWINGS

DETAILED DESCRIPTION OF THE INVENTION

Figure 1:
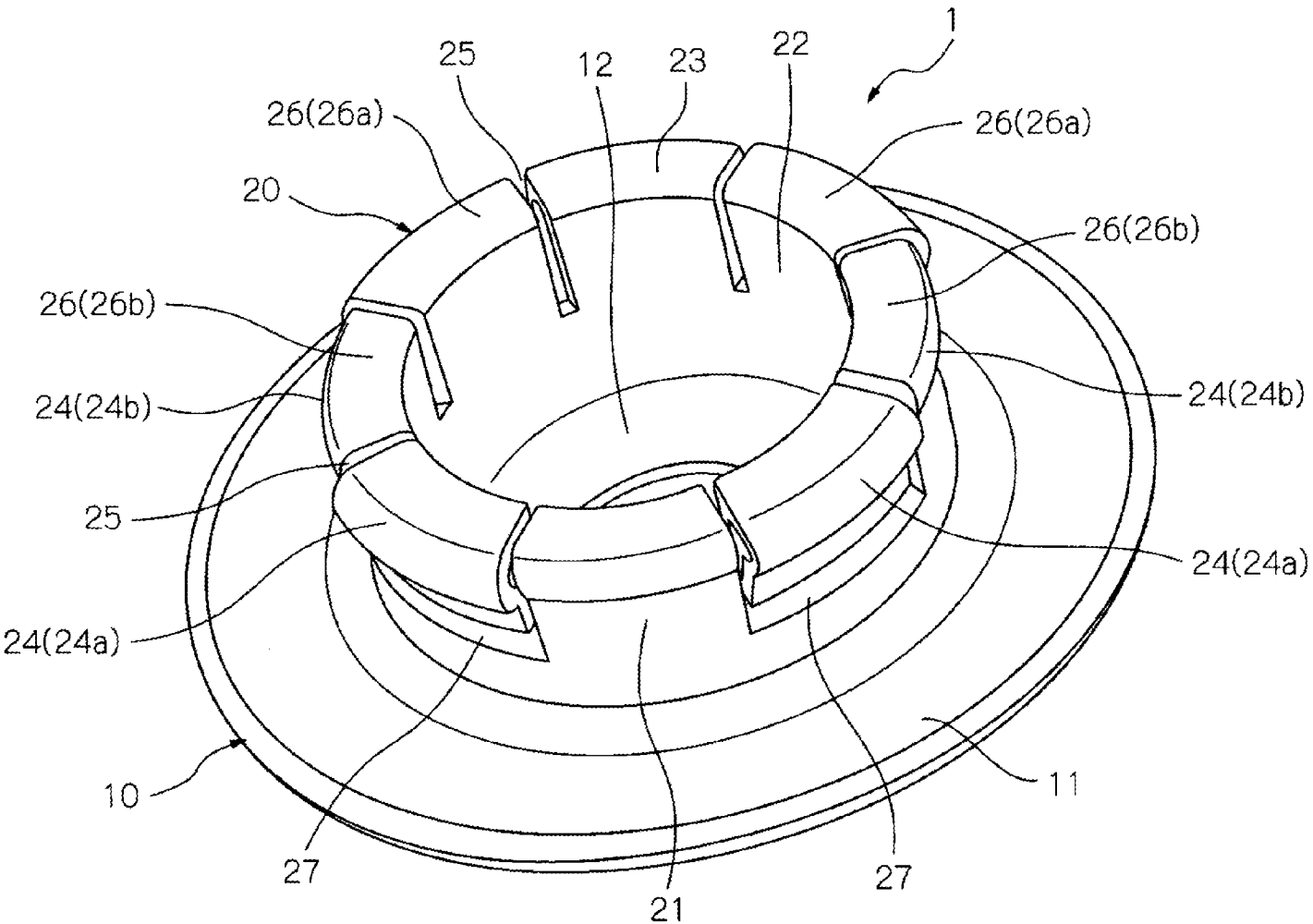
FIG. 1 is a perspective view of a male snap part according to an embodiment of the present invention.
Figure 2:
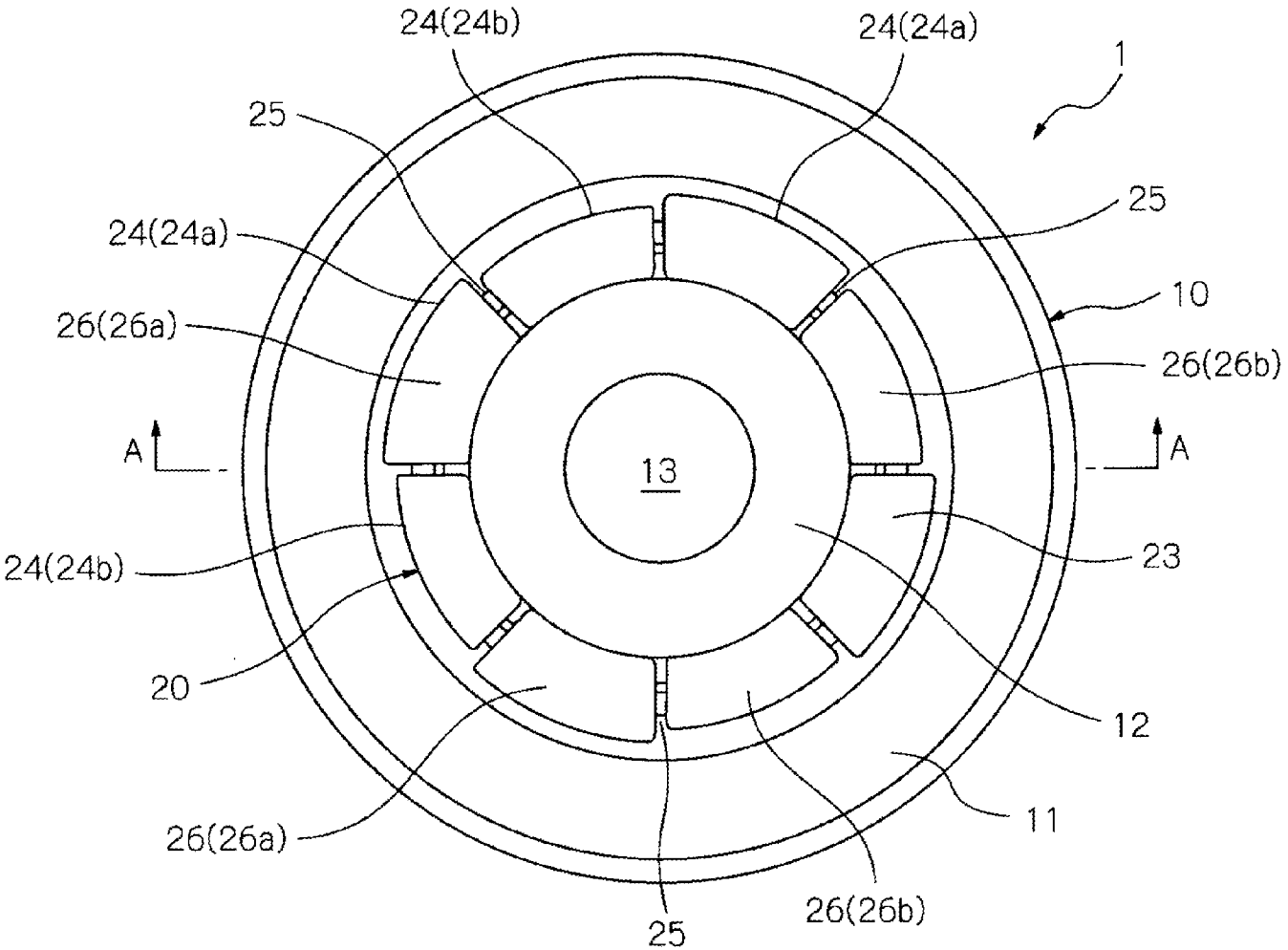
FIG. 2 is a plane view of the male snap part of FIG. 1.
Figure 3:
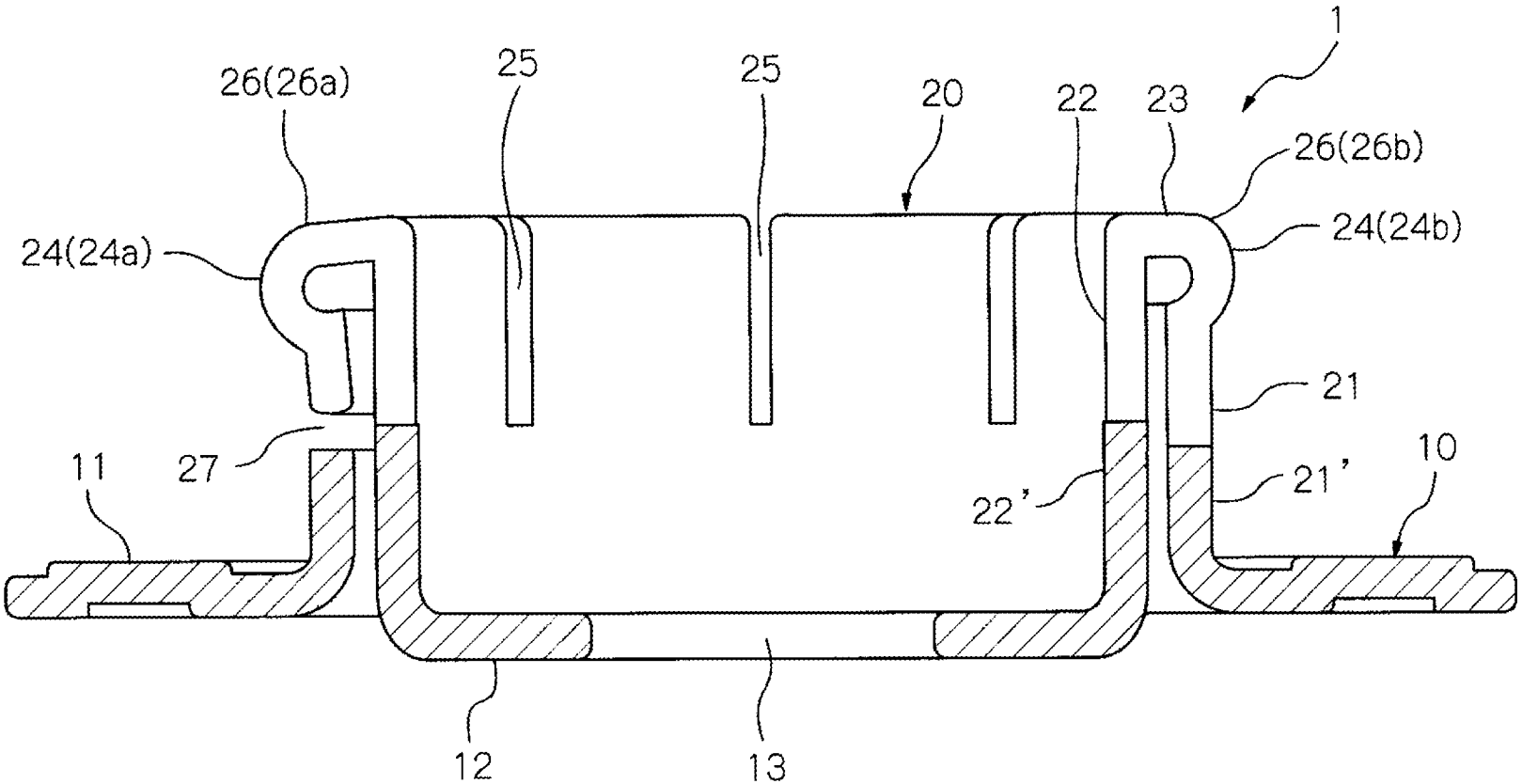
FIG. 3 is a sectional view taken along the line A-A in FIG. 2 viewing posteriorly.

Hereinafter, preferred embodiments of a male snap part (male snap) and a female snap part (female snap) according to the present invention will be described with referent to the drawings. In the following, directions such as upper, lower, right, left, etc. are based on the drawings being referred to. FIGS. 1 and 2 are a perspective view and a plan view of a male snap 1 according to an embodiment of the present invention, respectively. FIG. 3 is an sectional view taken along the line A-A in FIG. 2 viewing posteriorly. The male snap 1 is formed by drawing a brass plate and includes a circular base 10 and a cylindrical projection 20 which projects upward from the base 10. As can be seen from FIG. 3, the projection 20 is composed of an outer cylindrical portion 21, an inner cylindrical portion 22 and a top portion 23 which connects the upper ends of the outer and inner cylindrical portions 21 and 22. The outer cylindrical portion 21 includes, at its upper part, arc-shaped outer bulges 24 (24*a*, 24*b*) which bulge outward in the radial direction of the projection 20. The base 10 includes a flange 11 extending outward in the radial direction from the lower end of the outer cylindrical portion 21 and an inner base portion 12 extending inward in the radial direction from the lower end of the inner cylindrical portion 22. In the inner base portion 12, there is provided an opening 13 for passing e.g. a post of a button fixing member such as a rivet when the male snap 1 is being fixed to fabric C (See FIG. 4). The inner base portion 12 is slightly lower than the flange 11.

The projection 20 is partitioned into, by way of example, eight segments 26 (26*a*, 26*b*) by making eight longitudinal slits 25 from the top of the projection 20 at intervals of 45° in the circumference direction. Each longitudinal slit 25 cuts through the top portion 23 and then through the outer and inner cylindrical portions 21 and 22 to the extent of approximately half the height of the projection 20. Accordingly, in the outer and inner cylindrical portions 21 and 22, there are slit-free areas 21', 22' (see FIG. 3) at their lower half parts. If each longitudinal slit 25 were too deeply cut from the top of the projection 20 to near the base 10, the strength of the base 10 would decrease. In this case, the shape of the base 10 may be altered at the time of fixing the male snap 1 to the fabric C (see FIG. 4). However, thanks to the existence of the slit-free areas 21', 22' as mentioned above, such decrease in strength and change in shape of the base 10 can be prevented. On the other hand, if each longitudinal slit 25 were cut too shallowly from the top of the projection 20 terminating near the top, it might be hard to gain required elastic deformability of the projection 20. The approximately half height slits 25 can make the elasticity of the projection 20 appropriate. The eight segments 26 are composed of four segments 26*a* with lateral slits 27 and four remaining segments 26*b* without such lateral slits, each segment 26*a* and each remaining segment 26*b* being arranged alternately in the circumference direction. In each segment 26*a*, each of the lateral slits 27 is formed in through the outer cylindrical portion 21 so as to connect the lower ends, in the outer portion 21, of two longitudinal slits 25 between which each segment 26*a* is present. The lateral slits 27 divide the segments 26*a* in the outer cylindrical portion 21 into upper parts and lower parts. Therefore, in the inner cylindrical portion 22, the segments 26*a* are connected to the base 10 (the inner base portion 12), while in the outer cylindrical portion 21, the upper parts of the segments 26*a* are not connected to the base 10, although the lower parts of the segments 26*a* are connected to the base 10 (the flange 11). Meanwhile, the remaining segments 26*b* are connected to the base 10 both in the inner and outer cylindrical portions 21 and 22. Accordingly, the segments 26*a* with the lateral slits 27 are more elastically deformable in the radial direction than the remaining segments 26*b*. The segment(s) 26*a* is also hereinafter referred to as the "highly deformable segment(s) 26*a*," and the remaining segment(s) 26*b* is also hereinafter referred to as the "low deformable segment(s) 26*b*." Further, the outer bulges (large outer bulges) 24*a* in the highly deformable segments 26*a* bulge more outward in the radial direction than the outer bulges (small outer bulges) 24*b* in the low deformable segments 26*b*.

Figure 4:
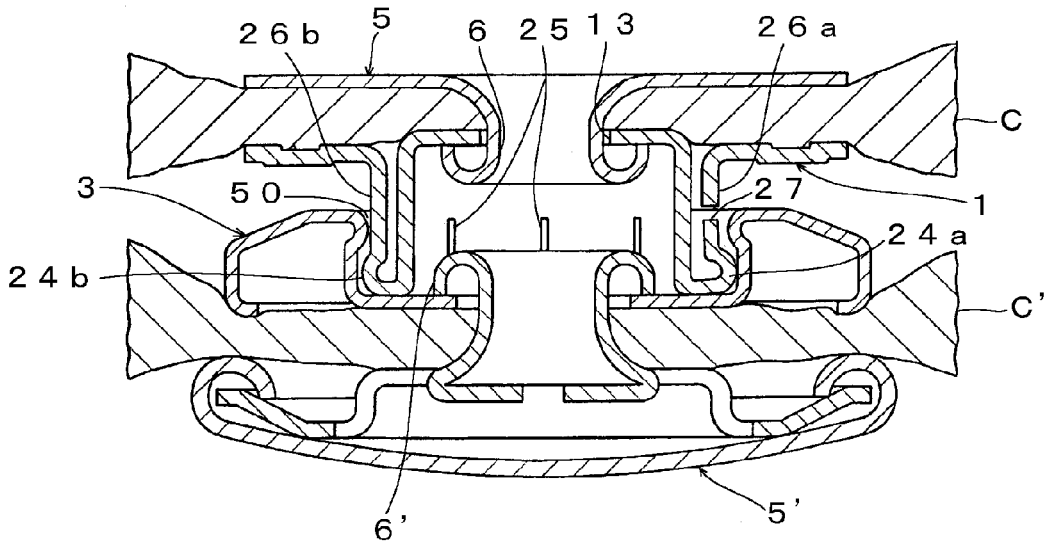
FIG. 4 is a longitudinally sectional view indicating the male snap part engaged with a conventional female snap part.

Though the above-mentioned male snap part 1 can be used with the after-mentioned female snap part 2 according to the present invention, the male snap 1 is normally used with conventional female snaps. FIG. 4 is a longitudinally sectional view indicating the male snap 1 engaged with a conventional female snap 3. In FIG. 4, for the sake of convenience, the highly deformable segment 26*a* of the male snap 1 is shown in the right side and the low deformable segment 26*b* is shown in the left side. The female snap 3 includes a depression 50 for detachably receiving therein the projection 20 of the male snap 1, and a cylindrical portion 51 defining the depression 50 therein. The cylindrical portion 51 includes, at its upper part or open end side part of the depression 50, an annular, inner bulge (female bulge) 51' which bulges inward in the radial direction. In FIG. 4, both the male snap 1 and the female snap 3 have been fixed to fabrics C, C', respectively, using rivets 5, 5' by swaging their posts 6, 6' after the posts 6, 6' passed through the fabrics C, C' and then through the openings (13) of the snaps 1, 3.

Figure 5:
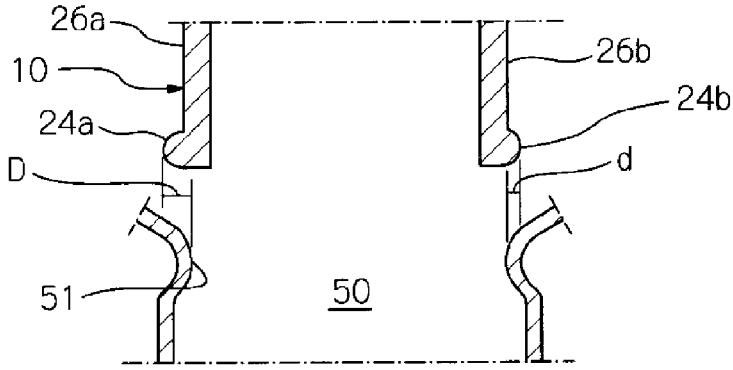
FIG. 5 is a schematic view showing the projection of the male snap part and the depression of the female snap part facing to each other just before their engagement.

FIG. 5 is a schematic view showing the projection 20 of the male snap 1 and the depression 50 of the female snap 3 concentrically facing to each other just before their engagement. In FIG. 5, the projection 20 is depicted by omitting the divisions of the outer and inner cylindrical portions 21, 22 and the top portion 23. As can be seen from FIG. 5, between the large outer bulge 24*a* of the projection 20 and the inner bulge 51' of the cylindrical portion 51 defining the depression 50, there is a relatively large overlapping D in the axial direction, while between the small outer bulge 24*b* and the inner bulge 51', there is a smaller overlapping d than the large overlapping D. The outer diameter of the small, outer bulge 24*b* is almost the same as (slightly larger than) the inner diameter of the female bulge 51'. When the male snap 1 is being coupled with the female snap 3, the outer bulges 24*a*, 24*b* of the projection 20 come into contact with the female bulge 51' and then the segments 26*a*, 26*b* are elastically deformed inward in the radial direction by the engagement between the outer bulges 24*a*, 24*b* and the inner bulge 51'. At this moment, the highly deformable segments 26*a* having the large bulges 24*a* and the lateral slits 27 are displaced more inwardly than the low deformable segments 26*b*. Once the male bulges 24*a*, 24*b* have passed over the female bulge 51', they return outwardly to their initial states (the large bulges 24*a* may not completely return to the initial state), completing the coupling between the projection 20 of the male snap 1 and the depression 50 of the female snap 3 as shown in FIG. 4.

Since the male snap 1 includes the highly deformable segments 26*a* and the low deformable segments 26*b* alternately in the circumference direction, its coupling strength between the male and female snaps 1 and 3 is greater than that of male and female snaps with only highly deformable segments, and it is easier to attach and detach the male snap 1 to and from the female snap 3 than male and female snaps with only low deformable segments. Further, since the large bulges 24*a* of the highly deformable segments 26*a* can be considerably caught by the female bulge 51' of the female snap 3, the coupling strength (or the detaching resistance) between the snaps 1 and 3 increases. Furthermore, the alternate large bulges 24*a* and small bulges 24*b* in the circumference direction in the male snap 1 can enhance the resistance for the projection 20 to rotate relative to and within the depression of the female snap 3. Accordingly, for instance, the male snap 1 is not detached from the female snap 3 too easily against a force so as to separate the coupled snaps 1 and 3 horizontally in the opposite directions, by keeping the large bulges 24*a* of the highly deformable segments 26*a* caught by the female bulge 51' while the segments 26*a* are elastically deformed.

Figure 6:
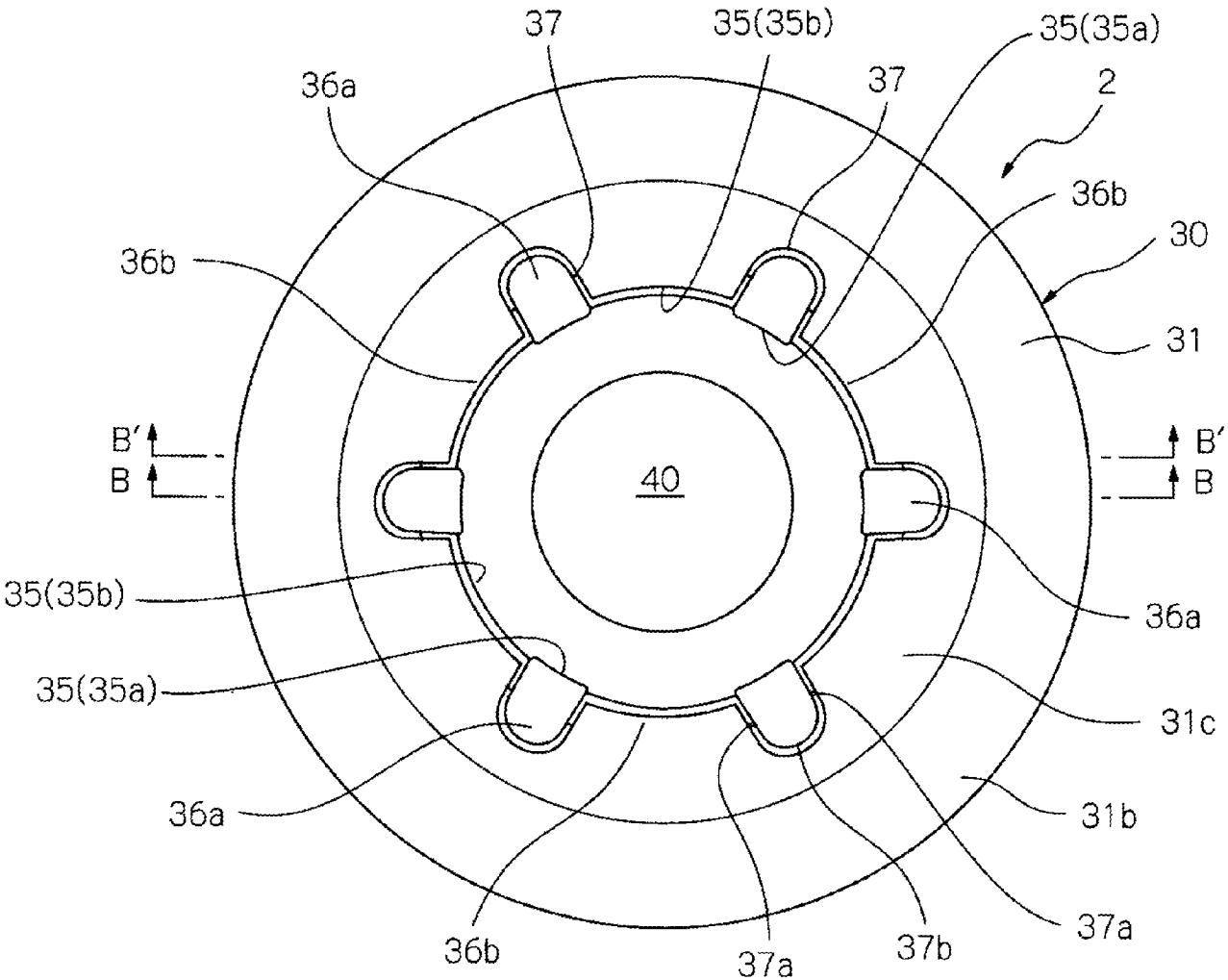
FIG. 6 is a perspective view of a female snap part according to an embodiment of another present invention.
Figure 7:
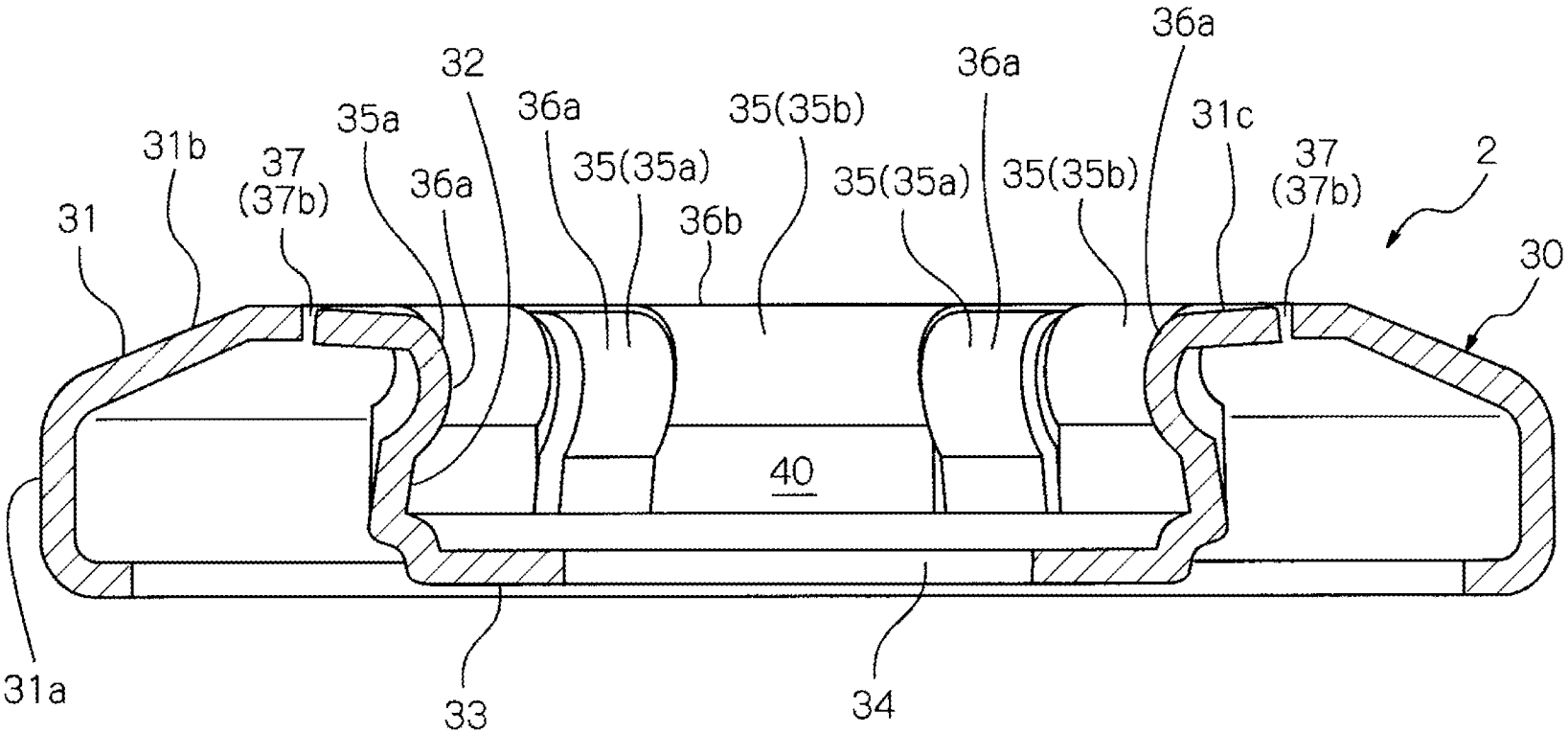
FIG. 7 is a plane view of the female snap part of FIG. 1.
Figure 8:
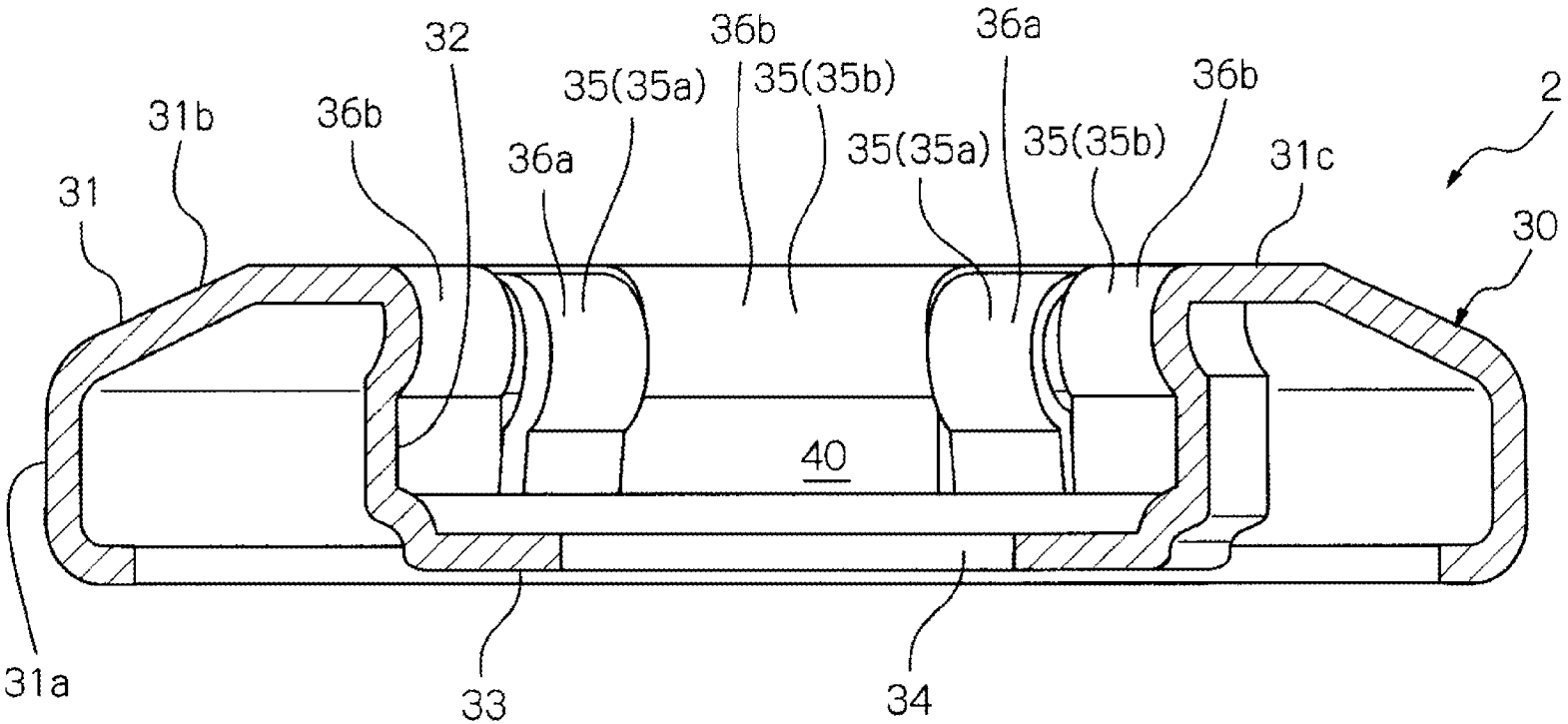
FIG. 8 is a sectional view taken along the line B-B in FIG. 6 viewing posteriority.
Figure 9:
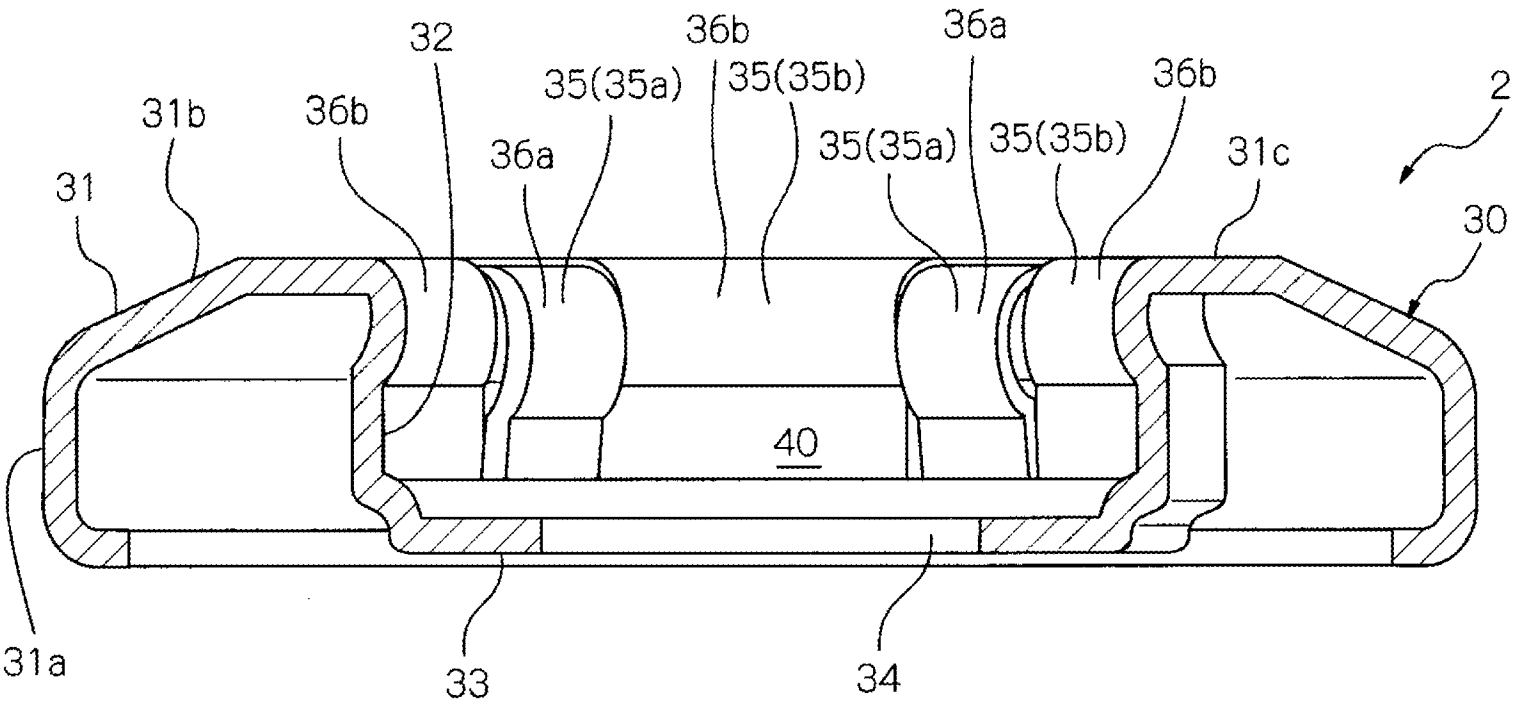
FIG. 9 is a sectional view taken along the line B'-B' of FIG. 6 viewing posteriority.

Next, a female snap part (female snap) 2 according to an embodiment of the present invention will be described. FIGS. 6 and 7 are a perspective view and a plane view of the female snap 2, respectively. FIGS. 8 and 9 are sectional views taken along the lines B-B and B'-B' in FIG. 7, respectively, viewing posteriorly. The female snap 2 comprises a circular main body 30, which is formed by drawing a brass plate, and a cylindrical depression 40 in the center of the main body 30 for detachably receiving therein the projection of a male snap (this male snap is normally conventional one, though the male snap 1 according to the present invention can be used). The main body 30 is composed of an inner cylindrical portion 32 defining the depression 40 therein. an outer circumference portion 31 extending outward in the radial direction from the upper end of the cylindrical portion 32 and defining the thickness (height) of the female snap 2, and an inner base portion 33 as the bottom of the depression 40. In the inner base portion 33, there is provided an opening 34 for passing e.g. a post of a button fixing member such as a rivet when the female snap 2 is being fixed to fabric C (See FIG. 10). The outer circumference portion 31 includes an outer cylindrical portion 31*a* at the most outer side in the radial direction, an inclined portion 31*b* extending from the upper end of the outer cylindrical portion 31*a* inward in the radial direction while rising, and a flat top portion 31*c* extending between the inner end of the inclined portion 31*b* and the upper end of the inner cylindrical portion 32. The inner cylindrical portion 32 includes, at its upper part, arc-shaped inner bulges 35 (35*a*, 35*b*) which bulge inward in the radial direction.

In the inner cylindrical portion 32 and the flat top portion 31*c*, there are provided, by way of example, six highly deformable segments 36*a* at intervals of 60° in the circumference direction, the segments 36*a* being separated from the other part of the cylindrical and flat top portions 32, 31*c* by inverted U-shaped slits 37. Each of the slits 37 is composed of a pair of parallel longitudinal slits 37*a*, and an arc-shaped slit (a lateral slit) 37*b* connecting the ends, in the flat top portion 31*c*, of the parallel longitudinal slits 37*a*. In the inner cylindrical portion 32, there are six remaining portions 36*b* between adjacent two of the highly deformable portions 36*a* in the circumference direction. The remaining portions 36*b* are hereinafter referred to as the "non-deformable segments 36*b*." Each of the highly deformable segments 36*a* is connected only to the inner base portion 33 and is slightly tilted to inward in the radial direction from its lower end at the boundary with the inner base portion 33. Accordingly, the highly deformable segments 36*a* are much more elastically deformable in the radial direction than the non-deformable segments 36*b*. The non-deformable segments 36*b* can be slightly and elastically deformable. Further, the inner bulges (large inner bulges) 35*a* in the highly deformable segments 36*a* bulge more inward in the radial direction than the inner bulges (small inner bulges) 35*b* in the non-deformable segments 36*b*.

Figure 10:
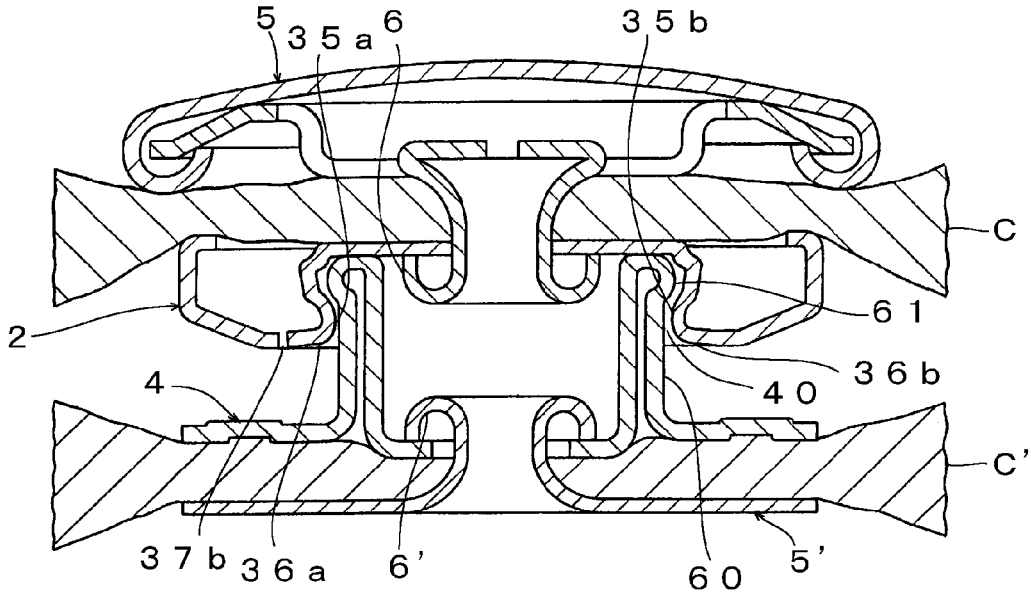
FIG. 10 is a longitudinally sectional view indicating the female snap part engaged with a conventional male snap part.

Though the above-mentioned female snap part 2 can be used with the above-mentioned male snap part 1 according to the present invention, the female snap 2 is normally is used with conventional male snaps. FIG. 10 is a longitudinally sectional view schematically indicating the female snap 2 engaged with a conventional male snap 4. In FIG. 10, for the sake of convenience, the highly deformable segment 36*a* of the female snap 2 is shown in the left side and the non-deformable segment 36*b* is shown in the right side. The male snap 4 includes a projection 60 for detachably being inserted into the depression 40 of the female snap 2. The projection 60 includes, at its upper or distal part, an annular, outer bulge (male bulge) 61 which bulges outward in the radial direction. In FIG. 10, both the female snap 2 and the male snap 4 have been fixed to fabrics C, C', respectively, using rivets 5, 5' by swaging their posts 6, 6' after the posts 6, 6' passed through the fabrics C, C' and then through the openings (34) of the snaps 2, 4.

Figure 11:
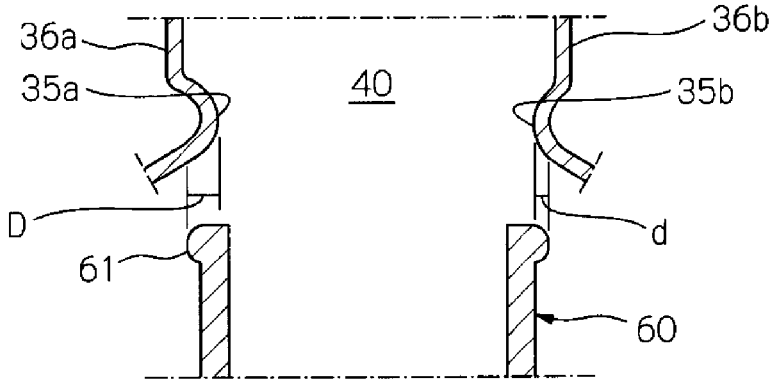
FIG. 11 is a schematic view showing the depression of the female snap part and the projection of the male snap part facing to each other just before their engagement.

FIG. 11 is a schematic view showing the depression 40 of the female snap 2 and the projection 60 of the male snap 4 concentrically facing to each other just before their engagement. As shown in FIG. 10, the projection 60 is composed of an inner cylindrical portion, an outer cylindrical portion and a top portion which connects the upper ends of the outer and inner cylindrical portions, but In FIG. 11, the projection 60 is depicted by omitting the divisions of the outer and inner cylindrical portions and the top portion. As can be seen from FIG. 11, between the large inner bulge 35*a* of the inner cylindrical projection 32 defining the depression 40 and the inner outer bulge 61 of the projection 60, there is a relatively large overlapping D in the axial direction, while between the small inner bulge 35*b* and the outer bulge 61, there is a smaller overlapping d than the large overlapping D. The inner diameter of the small, inner bulge 35*b* is almost the same as (slightly smaller than) the outer diameter of the male bulge 61. When the female snap 2 is being coupled with the male snap 4, the inner bulges 35*a*, 35*b* of the depression-defining portion 32 come into contact with the male bulge 61 and then the segments 36*a*, 326*b* are elastically deformed outward in the radial direction by the engagement between the inner bulges 35*a*, 35*b* and the outer bulge 61. At this moment, the highly deformable segments 36*a* having the large bulges 35*a* and the lateral slits 37*b* are displaced more outwardly than the non-deformable segments 36*b*. Once the female bulges 35*a*, 35*b* have passed over the male bulge 61, they return inwardly to their initial states (the large bulges 35*a* may not completely return to the initial state), completing the coupling between the depression 40 of the female snap 2 and the projection 60 of the male snap 4 as shown in FIG. 10.

Since the female snap 2 includes the highly deformable segments 36*a* and the non-deformable segments 36*b* alternately in the circumference direction, its coupling strength between the female and male snaps 2 and 4 is greater than that of female and male snaps with only highly deformable segments, and it is easier to attach and detach the female snap 2 to and from the male snap 4 than female and male snaps with only non-deformable segments. Further, since the large bulges 35*a* of the highly deformable segments 36*a* can be considerably caught by the male bulge 61 of the male snap 4, the coupling strength (or the detaching resistance) between the snaps 2 and 4 increases. Furthermore, the alternate large bulges 35*a* and small bulges 35*b* in the circumference direction in the female snap 2 can enhance the resistance for the projection 60 of the male snap 4 to rotate relative to and within the depression 50 of the female snap 2. Accordingly, for instance, the female snap 2 is not detached from the male snap 4 too easily against a force so as to separate the coupled snaps 2 and 4 horizontally in the opposite directions, by keeping the large bulges 35*a* of the highly deformable segments 36*a* caught by the male bulge 61 while the segments 36*a* are elastically deformed.

DESCRIPTION OF REFERENCE NUMBERS

1 male snap part (male snap)
2 female snap part (female snap)
20 projection
24*a* large outer bulge
24*b* small outer bulge
25 longitudinal slit
26*a* highly deformable segment
26*b* low deformable segment
27 lateral slit
30 circular main body
32 inner cylindrical portion (depression-defining portion)
40 depression
35*a* large inner bulge
35*b* small inner bulge
36*a* highly deformable segment
36*b* non-deformable segment
37*a* longitudinal slit
37*b* lateral slit

What is claimed is:

1. A male snap part made of metal having a cylindrical projection to detachably engage with a projection receiving, cylindrical depression of a female snap part, wherein the projection is composed of an outer cylindrical portion, an inner cylindrical portion and a top portion which connects upper ends of the outer and inner cylindrical portions, wherein the projection includes a plurality of relatively highly deformable portions at predetermined angle intervals in a circumference direction of the projection, and a plurality of remaining portions, each remaining portion being arranged between adjacent two of the highly deformable portions in the circumference direction, the highly deformable portions being more deformable elastically in the outwardly radial direction of the projection than the remaining portions, wherein each of the highly deformable portions has a relatively large, outer bulge bulging more outward in the radial direction at an upper part of each of the highly deformable portions than an upper part of each of the remaining portions, wherein the projection includes longitudinal slits which are formed from the top portion to the outer and inner cylindrical portions and which partition the projection into the highly deformable portions and the remaining portions, and wherein the projection further includes lateral slits formed in the outer cylindrical portion, each of the lateral slits connecting lower ends of two longitudinal slits which define each highly deformable portion therebetween.

2. The male snap part according to claim 1, wherein each of the remaining portions has a relatively small, outer bulge bulging less outward in the radial direction at the upper part of each remaining portion than the large outer bulge of each highly deformable portion.

* * * * *

UNITED STATES PATENT AND TRADEMARK OFFICE

CERTIFICATE OF CORRECTION

PATENT NO. : 8,572,822 B2
APPLICATION NO. : 13/741640
DATED : November 5, 2013
INVENTOR(S) : Kenji Hasegawa It is certified that error appears in the above-identified patent and that said Letters Patent is hereby corrected as shown below:

In the Specification

In column 7, line 29, Delete “an” and insert -- An --, therefor.

In column 8, line 42, Delete “326b” and insert -- 36b --, therefor.

Signed and Sealed this
Fourth Day of March, 2014

Michelle K. Lee

Michelle K. Lee
*Deputy Director of the United States Patent and Trademark Office*